US010099280B2

(12) United States Patent
Gilmour et al.

(10) Patent No.: US 10,099,280 B2
(45) Date of Patent: Oct. 16, 2018

(54) DIE CASTING MOLD AND CAROUSEL

(71) Applicant: Farmer Mold and Machine Works, Inc., St. Petersburg, FL (US)

(72) Inventors: James Gilmour, St. Petersburg, FL (US); John Schiano, St. Petersburg, FL (US); John Goodman, St. Petersburg, FL (US); Ron Emerson, St. Petersburg, FL (US)

(73) Assignee: Farmer Mold and Machine Works, Inc., St. Petersburg, FL (US)

( * ) Notice: Subject to any disclaimer, the term of this patent is extended or adjusted under 35 U.S.C. 154(b) by 0 days.

(21) Appl. No.: 15/544,366

(22) PCT Filed: Dec. 2, 2016

(86) PCT No.: PCT/US2016/064826
§ 371 (c)(1),
(2) Date: Jul. 18, 2017

(87) PCT Pub. No.: WO2017/096305
PCT Pub. Date: Jun. 8, 2017

(65) Prior Publication Data

US 2018/0094773 A1 Apr. 5, 2018

Related U.S. Application Data

(60) Provisional application No. 62/262,754, filed on Dec. 3, 2015.

(51) Int. Cl.
*B22D 5/02* (2006.01)
*B22D 17/00* (2006.01)
(Continued)

(52) U.S. Cl.
CPC ..... *B22D 17/00* (2013.01); *B22D 5/02* (2013.01); *B22D 17/26* (2013.01); *B22D 47/00* (2013.01)

(58) Field of Classification Search
CPC ..... B22D 5/02; B22D 47/00; B22D 17/00; B22D 17/002; B22D 17/26; B22D 17/263
(Continued)

(56) References Cited

U.S. PATENT DOCUMENTS 3,305,890 A 2/1967 Senior et al.
3,741,281 A * 6/1973 Hauser-Lienhard .... B22C 9/046 164/253
(Continued)

FOREIGN PATENT DOCUMENTS

WO 02/22292 A1 3/2002

*Primary Examiner* — Kevin P Kerns
(74) *Attorney, Agent, or Firm* — Christopher Paradies; Paradies Law P.A.

(57) ABSTRACT

A die casting machine has a carousel and a plurality of molds disposed around the carousel. The carousel rotates about a central axis, such that each of the plurality of molds comes into a position for casting in turn. Each mold has a toggle mechanism and extraction pins. A gripping mechanism may extend up through a hole in the carousel table to couple the toggle mechanism to an actuator. At least one of the pins may have a pin brake such that the pins remain in position when the mold is opened, suspending a newly cast metal part in mid-air, when the brake is activated. When the brake is deactivated, the pins may retract, and the part may be removed without damaging the cast part.

20 Claims, 10 Drawing Sheets

(51) Int. Cl.
*B22D 17/26* (2006.01)
*B22D 47/00* (2006.01)

(58) Field of Classification Search
USPC ..... 164/130, 323, 324, 325, 326
See application file for complete search history.

(56) References Cited

U.S. PATENT DOCUMENTS

| | | | | |
|---|---|---|---|---|
| 4,861,542 | A | 8/1989 | Oles et al. | |
| 5,225,216 | A | 7/1993 | Barracchini et al. | |
| 7,406,997 | B2 * | 8/2008 | Beale et al. ..... | B22D 5/02 164/323 |
| 2014/0030373 | A1 | 1/2014 | Graffin | |

* cited by examiner

DIE CASTING MOLD AND CAROUSEL

CROSS RELATED APPLICATIONS

This application is a 371 U.S. national phase of International Application PCT/US2016/064826 filed Dec. 2, 2016 which claims priority to U.S. provisional application No. 62/262,754, entitled Die Casting Mold and Carousel, which was filed Dec. 3, 2015, and the disclosure and drawings of which are hereby incorporated by reference in their entirety.

FIELD OF THE INVENTION

The field relates to metal die casting and die injection molding of metal parts.

BACKGROUND

Die casting and die injection casting are commonly used to make metal parts. A die casting apparatus usually includes a pair of die halves each formed with a void corresponding to a portion of the metal article to be cast. When the two die halves are brought together in proper alignment, each respective void cooperates to form a die cavity having a shape of a metal part to be cast. Molten metal fills the void and solidifies as it cools in the die. Once the metal is solid, then the die halves are parted. Ejection pins may be activated after the dies are opened in order to push the cast metal part out of the die cavity. In some cases, a die release agent is first sprayed onto the die to prevent sticking of the metal part to the surface of the die.

An insert of an article of the same or a different metal or alloy may be placed in the die prior to casting. This complicates the die casting process, but offers advantages in some cases. These inserts are placed in the die cavity prior to die casting so that they become encapsulated by molten metal and become an integral part of a die cast article. For example, an insert may be located in a high stress portion of an article to bolster the casting, along contact surfaces to prevent coining or wear of the article, or to provide special properties such as electrical or thermal expansion properties.

SUMMARY

A die casting machine comprises a mold comprising a first portion and a second portion. The first portion comprises a first cavity, and the second portion comprises a second cavity. The first cavity and the second cavity are brought together and aligned by an alignment system such that a resultant cavity is formed, the resultant cavity is shaped such that a metal part if formed when molten (at least semisolid) metal is poured or injected into the resultant cavity. The first portion and the second portion are arranged and aligned to accommodate an insert. An operator or a robot inserts the insert between the first portion and the second portion prior to bringing the first portion and the second portion together to form the resultant cavity. In one example, the first portion is stationary, and the second portion is brought into contact with the first portion by moving the second portion (or vice versa). In an alternative example, both portions are moved in opposite directions to form a cavity around the insert. Either way, the first cavity and the second cavity form the resultant cavity around the insert, such that the insert is embedded and integrated within a metal cast in the resultant cavity during the die casting process.

The die casting machine comprises a plurality of pins extending through the first portion and the second portion, and the pins may be retractable and extendable independent of the movement of the first portion and the second portion. In one example, the pins extend with the first portion and the second portion, dependent on the movement of the first portion and the second portion in order to position the pins at the interior surface of the cavity, when the first portion and the second portion are closed to form the cavity.

In one example, the pins include a pin brake, which prevents the pins from being moved while the first portion and the second portion are opening and/or opened, after the die casting process is completed and the metal has solidified within the die. In this way, the cast metal part and the insert, now integrated into the case metal part, are suspended by contact with the stationary pins, while the first portion and the second portion are parted (i.e. opened). Alternatively, the metal part may be disposed in one or the other of the first portion or the second portion, while the other portion is withdrawn from the portion in which the part is disposed. Then, the cast metal part may be ejected from the portion in which it is disposed by activating a brake on the pins, while moving the portion in which the cast metal part is disposed away from the cast metal part, or by activating one or more pneumatic or hydraulic ejector pins. If ejector pins are activated, then the brake on the pins extending from the opposite cavity may be partially or entirely released to allow the pins to move as the ejector pins in a stationary portion of the die eject the part from the stationary portion of the die. Either way, the cast metal part becomes suspended in air by the pins, after the first portion and the second portion are parted, while the brakes on the pins of at least one portion of the die may be used to prevent the pins from moving, while the at least one portion of the die is moved away from another portion of the die. This provides an advantage over any known methods of die casting, because the cast metal parts may now be gently grasped by a robot or a human, wearing a heat resistant glove or using a tool or manipulator, since the cast metal part is suspended in mid-air by the pins. When the cast metal part is secured, the brakes on the pins may be released, and the pins retracted from the cast metal part.

Pin brakes are not known to be used on extraction pins in normal die casting or die injection molding machines to prevent the pins from moving during opening of the mold cavity. The purpose of the pins in conventional machines is to eject the part from the mold cavity. These ejector pins do not suspend the cast metal part in mid-air when mold halves are parted.

The die casting machine comprises a gate shear mechanism for shearing the gate from the cast metal part prior to parting the first portion from the second portion. In this way, the gate is removed and returned to the molten metal crucible to be remelted and reused in the casting process. Also, the shear mechanism allows the gate to be removed before the cast metal part is suspended in midair by the pins. Ordinary die casting machines do not shear the gate and automatically return the sprues and head portion of the casting on a conveyor to the furnace. Instead, the sprues and head portion are broken, cut or sheared off after removal from the mold and are collected in a bin for recycling later, usually.

In one example, the die casting machine comprises a plurality of molds, such as four molds, on a carousel. The carousel rotates about a central axis, moving each of the plurality of molds into position for casting in turn. This provides a substantial advantage, because a single human operator or robot can setup and cast metal parts with integrated inserts in each of the plurality of molds, in turn, while the molten metal is cast and the temperature of the mold returns to the proper temperature for casting of solid metal parts, before the part is removed from the mold. Thus, the correct number of dies may be provided to optimize the rate of casting, while utilizing a single operator to run the die casting machine. In one example, a single furnace heats a single source of molten metal for all of the molds, and the carousel brings the molds into alignment with the poured or injected molten metal from the furnace.

In one example, a movable chill plate, such as a copper chill plate, with or without liquid coolant passing through the chill plate, is used to cool the mold to the correct temperature range for pouring or injection of cast metal into the resultant cavity and for solidification of the metal within the cavity. In this way, the temperature of the first portion and the second portion may be controlled. For example, one or more temperature measurement devices, such as a thermocouple, thermistor or resistance temperature detector (RTD), may be used for measuring the temperature at a location in the first portion, the second portion, one of a plurality of chill plates or some combination of these. A temperature controller may utilize the temperature or temperatures measured in order to control when or if the chill plate is brought into contact with the first portion, the second portion or both the first portion and the second portion. For example, if the measured temperature exceeds a preset temperature trigger, determined from trial and error, then a first chill plate may be brought into contact with the first portion and a second chill plate may be brought into contact with the second portion, increasing the rate of cooling of the first portion and the second portion, until the temperature is brought below the same or another preset temperature, as the preset temperature trigger. For example, the preset trial and error temperature of a thermocouple in the first portion or the second portion is fifty percent (50%) of the boiling temperature of the fluid circulating through the first portion and/or the second portion. The fluid may be used for preheating and controlling the temperature of the first portion and/or the second portion, for example. In one example, a first chill plate is moved independently into contact with the first portion, when a temperature in the first portion exceeds a preset temperature, and a second chill plate may be moved, independently, into contact with a second portion, when a temperature of the second portion exceeds a preset temperature. This may be done to control the rate of solidification and the location of solidification during the casting process. For example, the temperature may be determined by trial and error, or an initial trigger temperature or profile of temperatures may be selected using a simulation of the casting process, such as a finite element model of the casting process.

In one example of a die casting apparatus for casting a part including an inserted component, the die casting machine comprises a mold comprising a first portion and a second portion and forming a cavity wherein the inserted component is inserted, such that the inserted component is embedded and integrated within the part, and a plurality of pins, and at least one of the plurality of pins extends through the first portion and at least one of the plurality of pins extends through the second portion; and a first pin actuator is coupled to at least one of the plurality of pins extending through the first portion, wherein the first pin actuator comprises a brake, such that, when the first portion is parted from the second portion, the at least one of the plurality of pins, extending through the first portion, remains in contact with the part, while the first portion is retracted from the part; and a second pin actuator coupled to at least one of the plurality of pins extending through the second portion, wherein the second pin actuator comprises a brake, such that, when the second portion is parted from the first portion, the at least one of the plurality of pins, extending through the second portion, remains in contact with the part, while the second portion is retracted from the part. The first pin actuator and the second pin actuator may be pneumatically actuated. A first toggle mechanism may be coupled to the first portion and arranged such that the first toggle mechanism opens and closes the first portion of the mold. A second toggle mechanism may be coupled to the second portion and arranged such that the second toggle mechanism opens and closes the second portion of the mold.

In one example, a rotary table may be arranged, wherein the rotary table comprises at least one through hole. For example, a pair of through holes may be provided. At least one through hole is disposed under the first toggle mechanism and the second toggle mechanism, for example. A first mold opening actuator may comprise a grip arranged at one end of a linear actuator, such that the grip is capable of extending through the one of the pair of holes arranged under the first toggle mechanism, and the grip may be arranged to temporarily couple the first mold opening actuator with the first toggle mechanism, such that the first toggle mechanism activates the closing and opening of the first portion of the mold. The second mold opening actuator may comprise a grip arranged at one end of a linear actuator, such that the grip is capable of extending through the one of the pair of holes arranged under the second toggle mechanism, and the grip may temporarily couple the second mold opening actuator with the second toggle mechanism, such that the second toggle mechanism activates the closing and opening of the second portion of the mold. The rotary table may be rotated on a rotary indexer, such that the first toggle mechanism is disposed above the first mold opening actuator and the second toggle mechanism is disposed above the second mold opening actuator, when the mold is rotated on the rotary table into an opening and closing position above the respective one of the first mold opening actuator and the second mold opening actuator by the rotary indexer. Closing of the first portion of the mold may be accomplished by the first toggle mechanism and closing of the second portion of the mold may be accomplished by the second toggle mechanism, and pulling the plurality of pins into position in the mold at a surface of the cavity. In one example, the opening of the first portion of the mold by the first toggle mechanism and the opening of the second portion of the mold by the second toggle mechanism opens the mold, while the brakes of the first pin actuator and the second pin actuator cause the pins to remain in contact with the part. In one example, the first pin actuator and the second pin actuator may be activated by a controller, retracting the plurality of pins from the part and releasing the part. A robot may be arranged to secure the part before the plurality of pins are activated by the controller.

For example, a tiltable gate and gate shearing device may be arranged on one of the first portion, the second portion or both the first portion and the second portion of the mold, such that, before the mold is opened, the gate shearing device is activated and shears the gate of the part, removing sprues and a header of a casting from the part. In one example, a conveyor may be provided, wherein the header and the sprues of the casting are deposited by the tiltable gate on the conveyor. The conveyor may be used to direct the header and the sprues to a furnace. The molds disposed on the table may comprise at least one additional mold, wherein the at least one additional mold is disposed on the rotary table. For example, a controller controls the rotary indexer to position the mold and the at least one additional mold, in turn, to pour or inject a molten material into each mold cavity and, in turn, to remove the part from each mold cavity, when the part is solidified. For example, four molds may be included on the rotary table, and the rotary indexer may rotate the rotary table in 90 degree increments. A first chill plate may comprise a plate actuator and a temperature regulated plate, wherein the plate actuator moves the temperature regulated plate into contact with the first portion of the mold, under control of a controller responding to a signal from a temperature sensing device.

In one example, a method of using any of the examples may comprise the steps of inserting the inserted component in the cavity of the mold comprising the first portion and the second portion; pouring a molten material, such as molten metal, such as lead, into the cavity of the mold, such that the inserted component is embedded and integrated within the part; parting the first portion from the second portion, retracting the first portion from the part and the second portion from the part, while applying a brake on the plurality of pins, such that, when the first portion is parted from the second portion, the at least one of the plurality of pins, extending through the second portion, remains in contact with the part, while the first portion is retracted from the part, and when the second portion is parted from the first portion, the at least one of the plurality of pins, extending through the second portion, remains in contact with the part, while the second portion is retracted from the part. The method may further comprise measuring a temperature related to the temperature of the first portion, the second portion or both the first portion and the second portion, using a temperature sensing device; transmitting a signal related to the temperature measured in the step of measuring to a controller; regulating the temperature of a temperature regulated plate of a first chill plate, a second chill plate or both a first chill plate and a second chill plate; and activating at least one plate actuator and moving at least one temperature regulated plate into contact with the first portion of the mold, the second portion of the mold or both the first portion of the mold and the second portion of the mold under control of the controller responding to the signal from the temperature sensing device.

BRIEF DESCRIPTION OF THE DRAWINGS

The following drawings are illustrative examples and do not further limit any claims that may eventually issue.

When the same reference characters are used, these labels refer to similar parts in the examples illustrated in the drawings.

DETAILED DESCRIPTION

Figure 1:
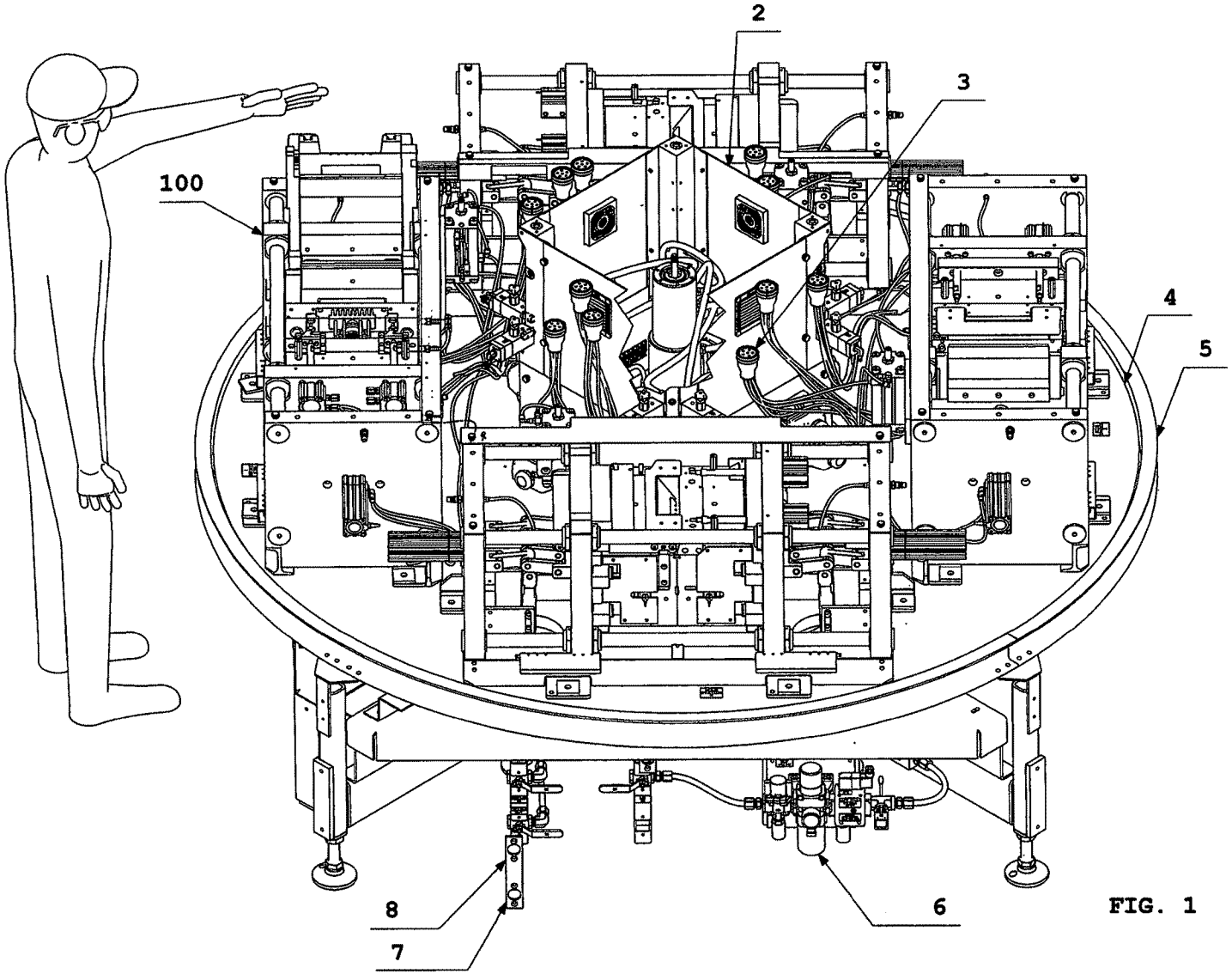
FIG. 1 illustrates a perspective view of a portion of a carousel comprising four casting molds for metal die casting.

FIG. 1 illustrates an example of a carousel of a die casting machine. There are four molds 100 disposed around the periphery of the carousel 4. A stationary guard 5 surrounds the carousel 4, which is capable of rotating about its central axis. A central utility distribution cabinet 2 is disposed on the carousel and rotates with the carousel 4, as each mold 100 is brought into position for casting, in turn. Only the lower cabinet is displayed in FIG. 1. The lower cabinet supplies temperature control fluid, both supply 8 and return 7, and electrical and instrumentation feeds, which are better seen in the partial cutaway view of FIG. 3. Ganged terminal connectors 3 are provided for pneumatics, which terminate in an upper main electrical control cabinet and are distributed through the pneumatic supply 6.

Figure 2:
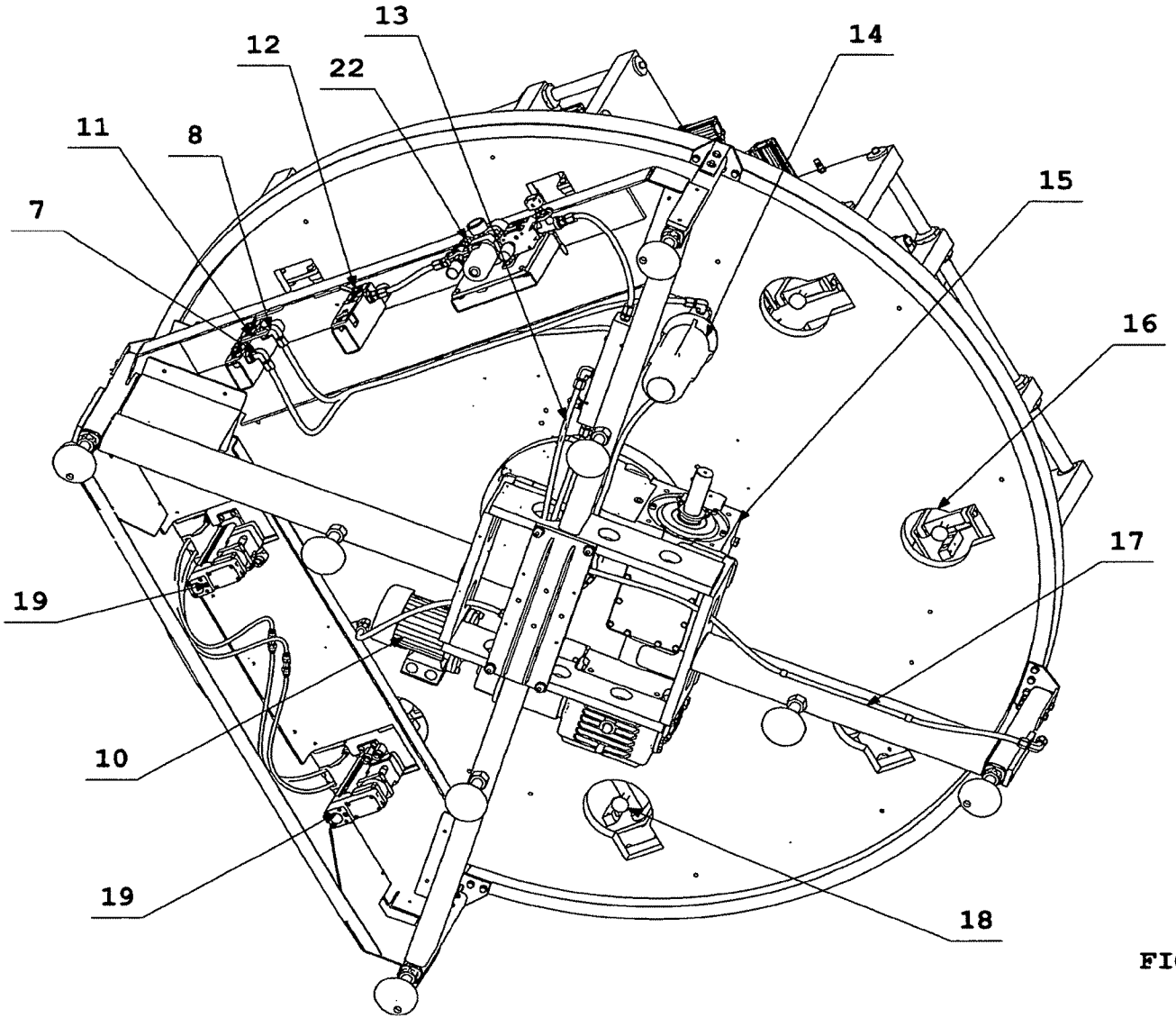
FIG. 2 illustrates a bottom perspective view of the carousel of FIG. 1.

FIG. 2 illustrates an example of a bottom view of the carousel of FIG. 1, showing temperature control fluid inlet and outlet assembly 11 comprising the return 7 and the supply 8, the pneumatic power inlet 12 with control and filtering devices 22 of the pneumatic supply 6. The pneumatic line 13 leads to the central core of the carousel. A temperature control fluid filter 14 is shown with a line for the temperature control fluid running to the central core of the carousel. A rotary indexer 15 engages the carousel, rotating the carousel at 90 degrees for precise placement of each mold 100, in turn, at the proper casting position. An electric motor 10 drives the rotary indexer 15, as is known in the art. Openings 16 are shown a support plate of the carousel that provide access to portions of the mold 100. For example, two openings are provided to access the mold opening ram and the gripper to grip the two mold toggle yokes 18, for example. Tandem mold opening actuators 19 are disposed under respective openings 16 and grip each mold toggle yoke 18 through the openings 16 in the carousel, when the mold 100 is in the casting position. In one example, a pneumatic branch 17 is provided to power components external to the carousel.

Figure 3:
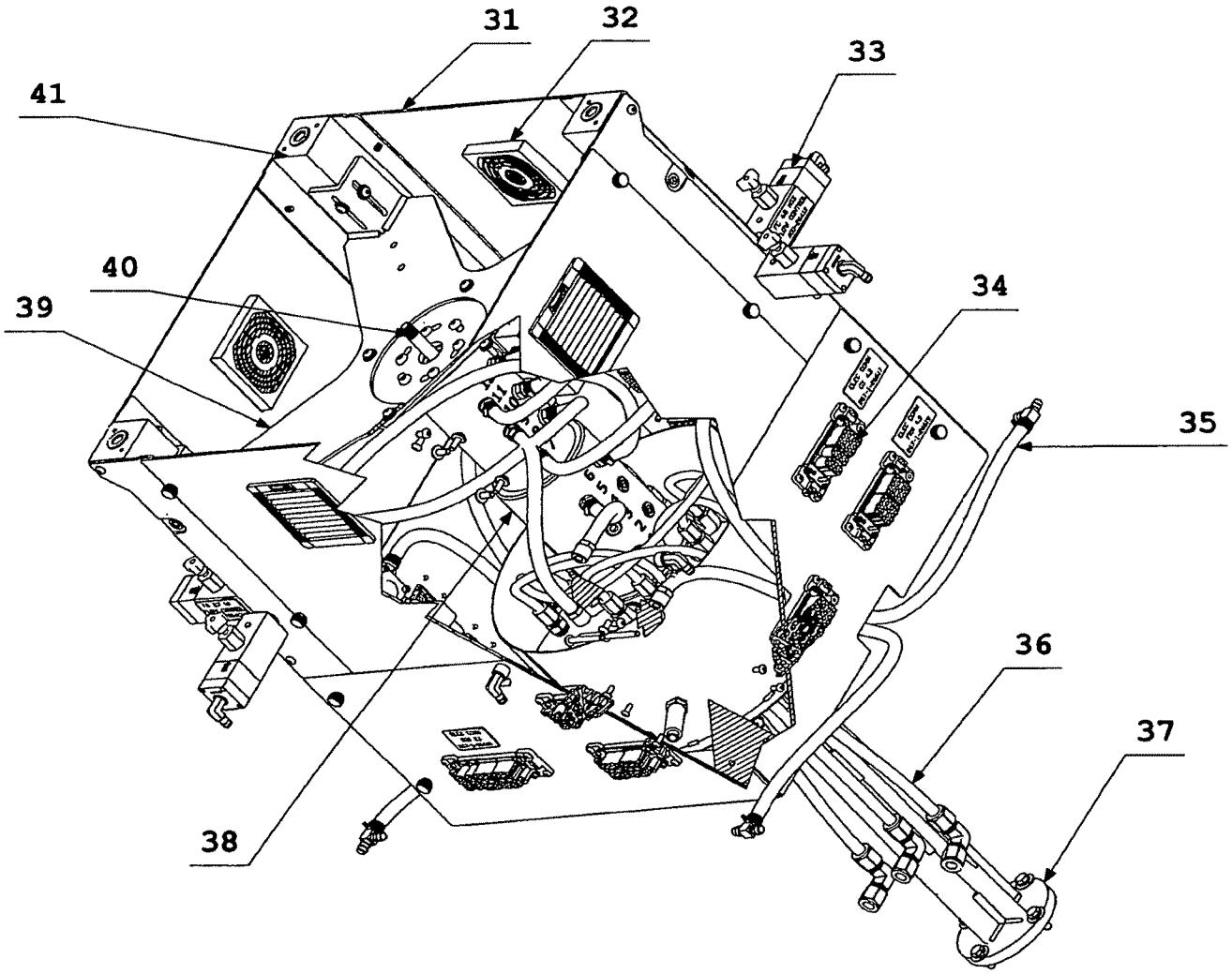
FIG. 3 illustrates a lower, central portion of the carousel cabinet of FIG. 1.

FIG. 3 provides a partial cutaway detail view of a lower, central cabinet 2. This portion of the cabinet 2 housing may be comprised of removable side walls 31, such as 8 removable side wall panels 31. As illustrated, four of the panels 31 have ventilating filters 32. Eight temperature control fluid metering flow controls 33, two per each of the four molds 100, extend from a channel formed through the corner posts 41 for return of temperature control fluid from each of the molds 100. These corner posts 41 provide structural support in addition to their role in returning the fluid. Electrical couplings 34 provide electrical connections, via pins and receptacles, as is known in the art, for electrical signals, thermocouples and power. For example, power is provided by couplings 34 to mold cartridge heaters, for preheating of molds 100, for example. Temperature control fluid tubing 35 supplies temperature control fluid to each of the molds 100 from a rotary distributor 38. Metal supply tubing 36 provides temperature control fluid, supply and return, and pneumatic supply to the rotary distributor 38 through the open core of the rotary indexer 15. Structural member 39 structurally couples the rotating cabinet 2 to the rotary distributor 38. The base 37 of the rotary distributor 38 is stationary, but the upper ported portion rotates with the cabinet 2, and flexible tubing distributes fluid in and out of the rotary distributor 38. A pneumatic supply line 40 extends through the central hollow core of the distributor 38, connecting to the upper portion of the cabinet (not shown here).

Figure 4:
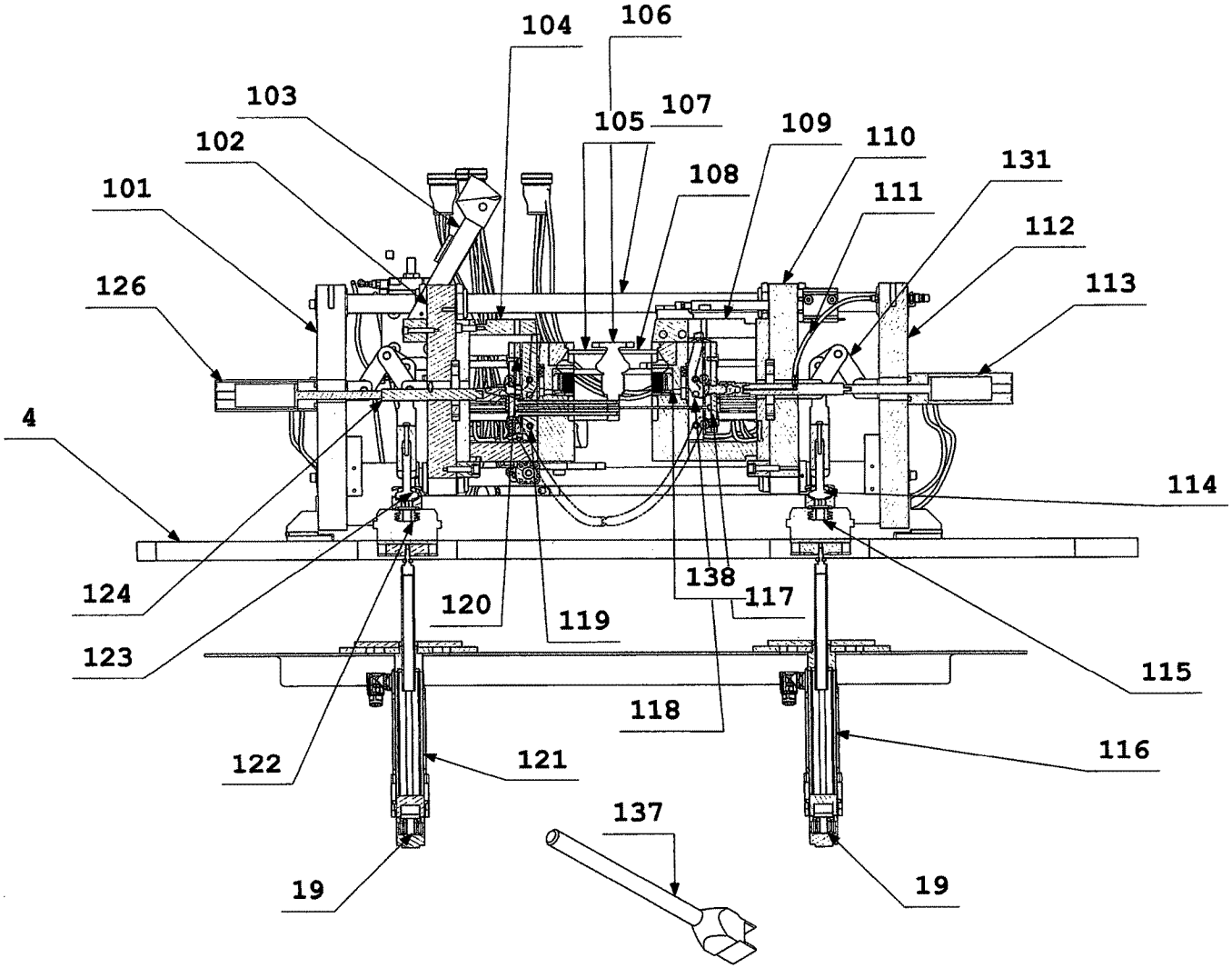
FIG. 4 illustrates a cross section of one of the molds illustrated in FIG. 1.

FIG. 4 illustrates a cross sectional view of a mold 100. Cross hatching shows the portions of the mold cut through in this cross sectional view through the center of the mold, for example. The tandom actuator and gripper 19, in this figure, is shown gripping the toggle yokes 114, 123 of the mold 100 with a pneumatically operated gripping end 115, 122. The linear actuators 116, 121 may be electrically driven, for example. For example, the gripping ends rotatably engage the toggle yokes 114, 123. The gripping ends may be activated pneumatically, for example. After being engaged pneumatically by the ends 115, 122, linear actuators 116, 121, for example, through the linkages 131, open and close the mold cavity, only when the mold cavity is in the casting position and only when the linear actuators 116, 121 are coupled to the toggle yokes 114, 123 of the mold 100. Therefore, the mold halves cannot be moved and positive safety is provided, for example, until any human is removed from the presence of the mold and a safety gate is closed. Four mold support bars 107 support the mold halves 104, 109, allowing the mold halves 104, 109 to translate to the left and right with respect to the figure. The support bars 107 pass through mold mounting plates 102, 110 to which the respective mold half 104 or 109 is mounted.

A pin unlocking shaft 124 is provided to decouple the pins from the linear actuator 126, for example, when the mold 100 is to be removed from the carousel. The two stationary mold plates 101, 112 are not removed when the mold 100 is removed, for example. Pin withdrawal cylinders 113, 126 work in tandem, activated pneumatically. Each is coupled to a plurality of pins 105, 108 by unlocking shafts 124. The unlocking shafts 124 may be activated pneumatically by pneumatic line 111. In order to remove the mold, both pneumatically activated unlocking shafts must be pneumatically unlocked via line 111, which is located on the left side, also, as shown on the right side. By pneumatically unlocking the pins from the actuators, removal of the mold is made more convenient. The pin actuators 113, 126 comprise a pin brake that prevents the pins from moving unless the brake is deactivated. This keeps the pins stationary and in contact with the newly cast part 106, when the mold halves 104, 109 are retracted to open the mold cavity, suspending the part 106 in mid-air, where an operator or a robot may secure the part 106 prior to retraction of the pins 105, 108. The pins are coupled to a respective one of the pin mounting plates 117, 120. Each mold half has one, and the pin heads are coupled to the pin mounting plate 117, 120, such that all of the pins coupled to a mounting plate 117, 120 are translated as the mounting plate 117, 120 is translated by the linear actuator 113 to which it is connected. In one example, a tool 137 or tools is inserted between the part 106 and one or both of the mold halves 104, 109, prior to retracting the pins 105, 108, in order to prevent the part from being drawn back into one half of the mold cavity, for example. This prevents damage to the manipulator of the robot or pinching of a human operator's hand, for example.

A chill plate 118, 119, which may be made of copper or other high conductivity metal, may be provided for each mold half 109, 104, respectively. The chill plate may be pneumatically moved into contact with its respective mold half, when needed, to cool the mold half (and the casting). Temperature control fluid may flow through channels formed in the chill plate to maintain the chill plate at a temperature less than the casting temperature of the mold half, for example. In this way, the cycle time may be reduced and safety may be enhanced.

One or more cartridge heaters 138 may be inserted in each mold half to heat the mold halves. For example, heating the mold halves may be used to preheat the mold halves to an acceptable operating temperature ranged, before commencing casting.

In the FIG. 4, a cast metal part 106 is held in mid-air by pins 105, 108, which are not retracted with the mold halves 104, 109. The gated mold half 104 is shown with the movable gate 103 lifted, which deposits the metal from the sprues and header onto a conveyor, which returns the metal to the molten metal pot or a recycling bin in order to be used again for casting. The opposite mold half 109 does not have a movable gate.

Figure 5:
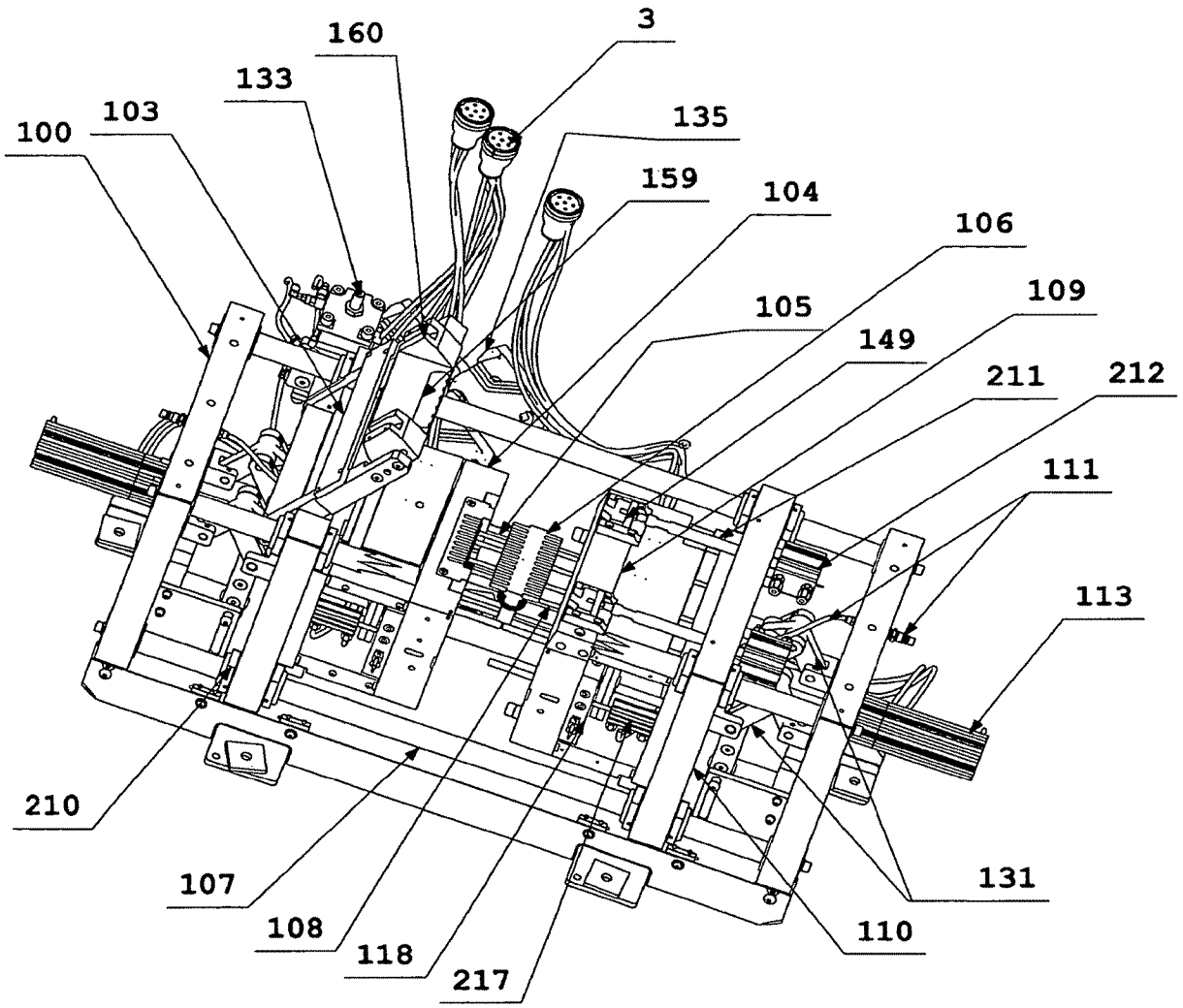
FIGS. 5 and 6 illustrate one of the molds of FIG. 1 with the gate sheared and a metal part held by pins in mid-air (FIG. 5) and with the metal part removed (FIG. 6).
Figure 6:
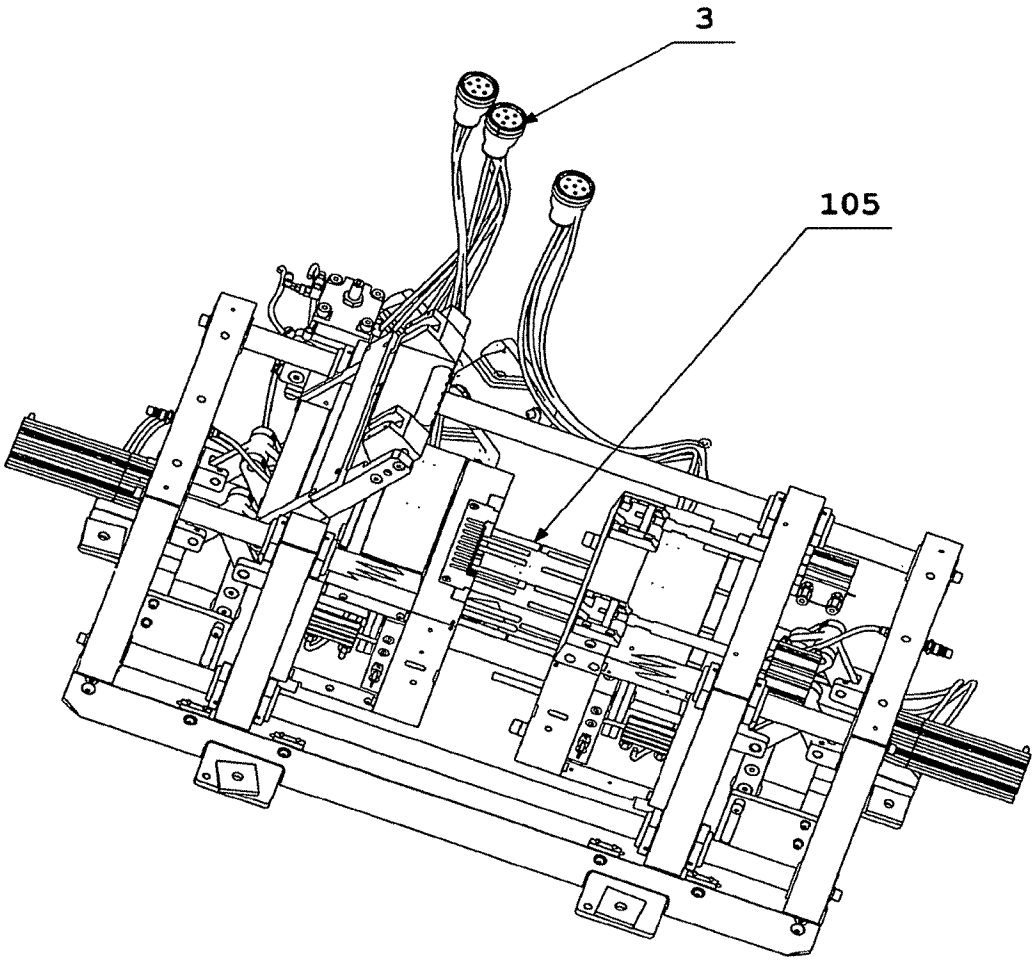

In FIGS. 5 and 6, the mold 100 is illustrated in a perspective view that shows a better view of the movable mold gate 103. A rotary actuator 133 pneumatically engages the movable gate 103, pivoting the movable gate 103 to a raised position, as shown in the drawing. For example, pneumatic connectors 3 couple pneumatic lines to a source of pneumatic pressure. Electrical connector 135 couples electrical power to mold heaters and thermocouples. For example, a cassette heater 138 may be coupled to electric power by such an electric coupling.

Gate shear mechanisms 149 on the right half of the mold are arranged to couple with a gate shear device 159 on the movable mold gate 103 coupled to the left half of the mold. The mechanisms 149 are displaced by rods 211, for example, by the activation of gate shear cylinders 212, which may be face mounted on insulating pads to insulate the cylinders 212 from the heat of the mold, for example. When the cylinders 212 are activated, then the rods 211 push the mechanisms 149 forward, engaging the cams 160 of the shear device 159, displacing the shear device 159 laterally, shearing the sprues of gate from the part 106. Then, as the rotary actuator 133 rotates the sprues and casting header, along with the movable gate 103, to deposit this metal onto a conveyor for delivery to furnace and recycling of the metal in a subsequent casting.

Another view of the pneumatic line 111 and compressed air fitting of the pneumatic unlocking link 124 is shown in FIG. 5. Also, a better top view of the linkage mechanisms 131 which opens and closes the mold halves is shown. Pushing the linkages opens the mold halves and pulling the linkages closes the mold halves, for example. In addition, this view shows the cooling plate cylinders 217, which is coupled to a cooling plate 118 for moving the cooling plate 118 into contact and out of contact with the mold half, for example, under control of a temperature control circuit based on temperature data received from a thermocouple inserted into the mold half. By managing mold heating and cooling, a specific temperature range may be selected for casting, and the rate of casting may be increased, for example. A rolling bearing with high temperature face seals 210 is shown on each side of each mounting plate 101, 110, where the mounting plate is engaged on the mold operating shafts 107, which reduces binding during movement of the mold halves due to temperature fluctuations, caused by temperature differences and thermal expansion and contraction during preheating and casting operations. FIG. 6 shows the pins 105, without the part being present.

Figure 7:
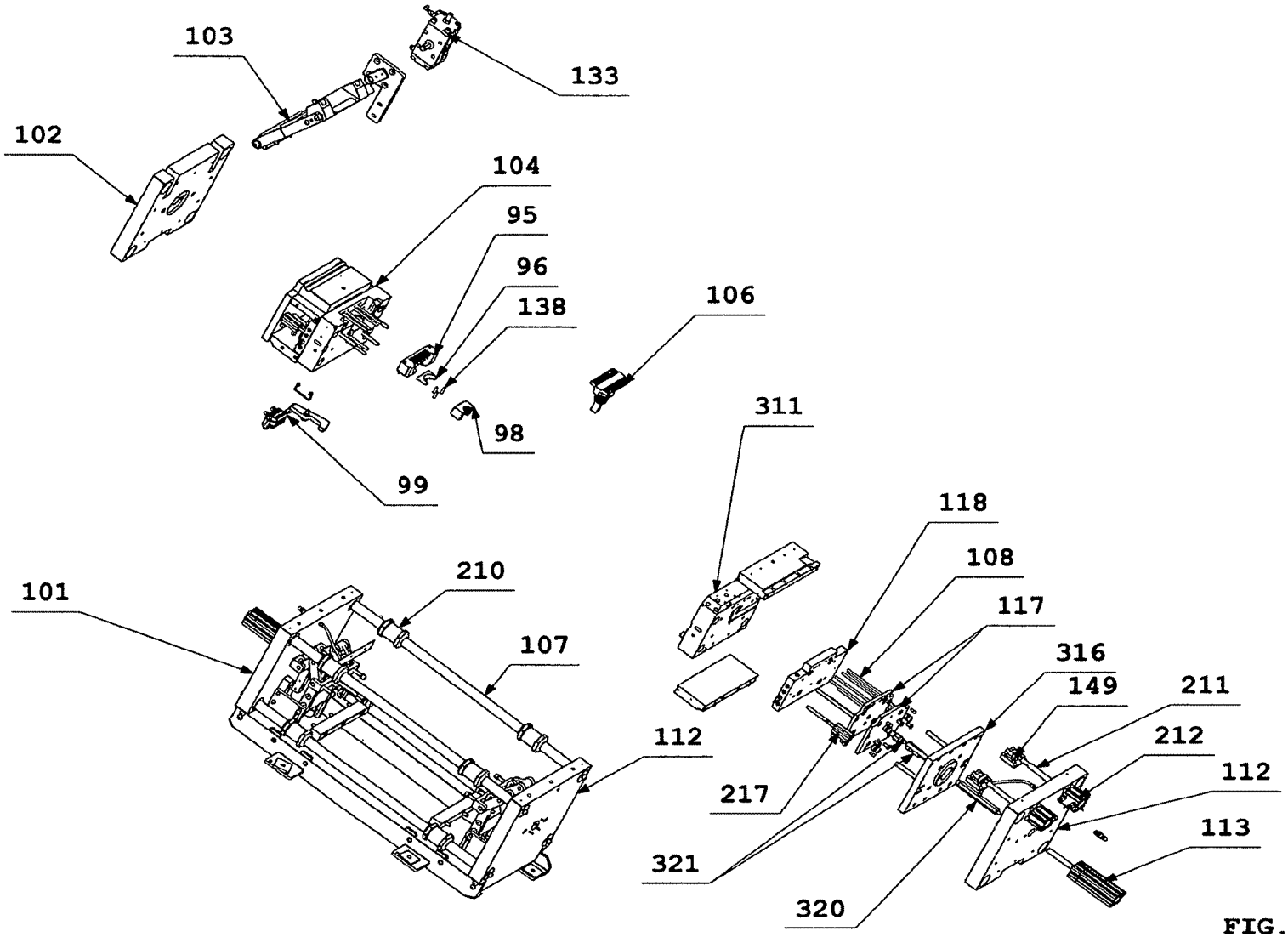
FIG. 7 illustrates an exploded view of the mold of FIG. 1.

FIG. 7 is an exploded view of the mold 100 that shows details of the parts not visible in the other drawings. A stationary mold plate 101 is shown with the mold halves removed. In this view, the shafts 107 and bearings 210 are clearly visible, the shafts 107 connecting the two stationary mold plates 101, 112 together, which provides a frame for supporting the mold halves. Mold support plate 102 is shown with pivotally movable gate 103 shown displaced from the plate 102 and its rotary actuator 133. The left mold half 104 is shown partially assembled, whereas the right mold half is shown completely disassembled in this exploded view from the mold back plate 316 to the mold cavity assembly 311. The inserts are removed from the left mold half 104, showing examples of inserts that, together, comprise the mold cavity. These inserts are not the portion of the part that is inserted and becomes an integral part of the finished part 106. Instead, these inserts may be provided in order to create a particular mold cavity for a particular part. For example, an upper crows foot 95, a center insert separator 96, a plurality of cartridge heaters 138 and a lower threaded portion 98 may be inserted into the mold half 104 to create the left half of the mold cavity. A latch mechanism 99 may be necessary to prevent the two mold halves from being pressed apart.

On the right half of the mold, a mold cavity assembly 311 is shown for the right mold half. Optionally, top and bottom separators may be coupled to the mold cavity assembly 311. Chill plate 118 is shown separated from the right mold cavity assembly 311. Pins 108 pass through holes in the chill plate 118 and are coupled between the pin mounting plates 117 with various screws and bushings, as shown. The right side mold support plate 112 is shown still attached to the shearing mechanisms 149, shear shafts 211 and gate shear cylinders 212. The pin cylinder and brake 113 is shown separate from the plate 112 to which it is attached in operation and separate from linkages 320 and 321. The cylinder and brake 113 is activated only to withdraw the pins 108. The pins 108 are pulled into position for casting by the toggle linkages 131 and actuators 116 during closing of the mold cavity. When the toggle actuators are activated to open the mold cavity, the pin cylinder 113 is inactive and the brake attached to the cylinder body prevents the pins from moving, holding the pins firmly in the extended position, while the mold halves are retracted to expose the part 106 and the pins 108. When the part 106 is ready to be released, then the pin cylinders 113, 126 are activated, which causes the pins 108 to be withdrawn from the part 106. A pneumatic interlock 320 couples the pin cylinders 113 to the pin linkage 321, which is coupled to the pin plates 117 and pins 108. The pneumatic interlock 320 makes disassembly of the mold more convenient, allowing the pin cylinders to remain attached to the stationary plates, even when the mold is removed from the stationary plates, such as during replacement or maintenance of the mold halves.

Figure 8:
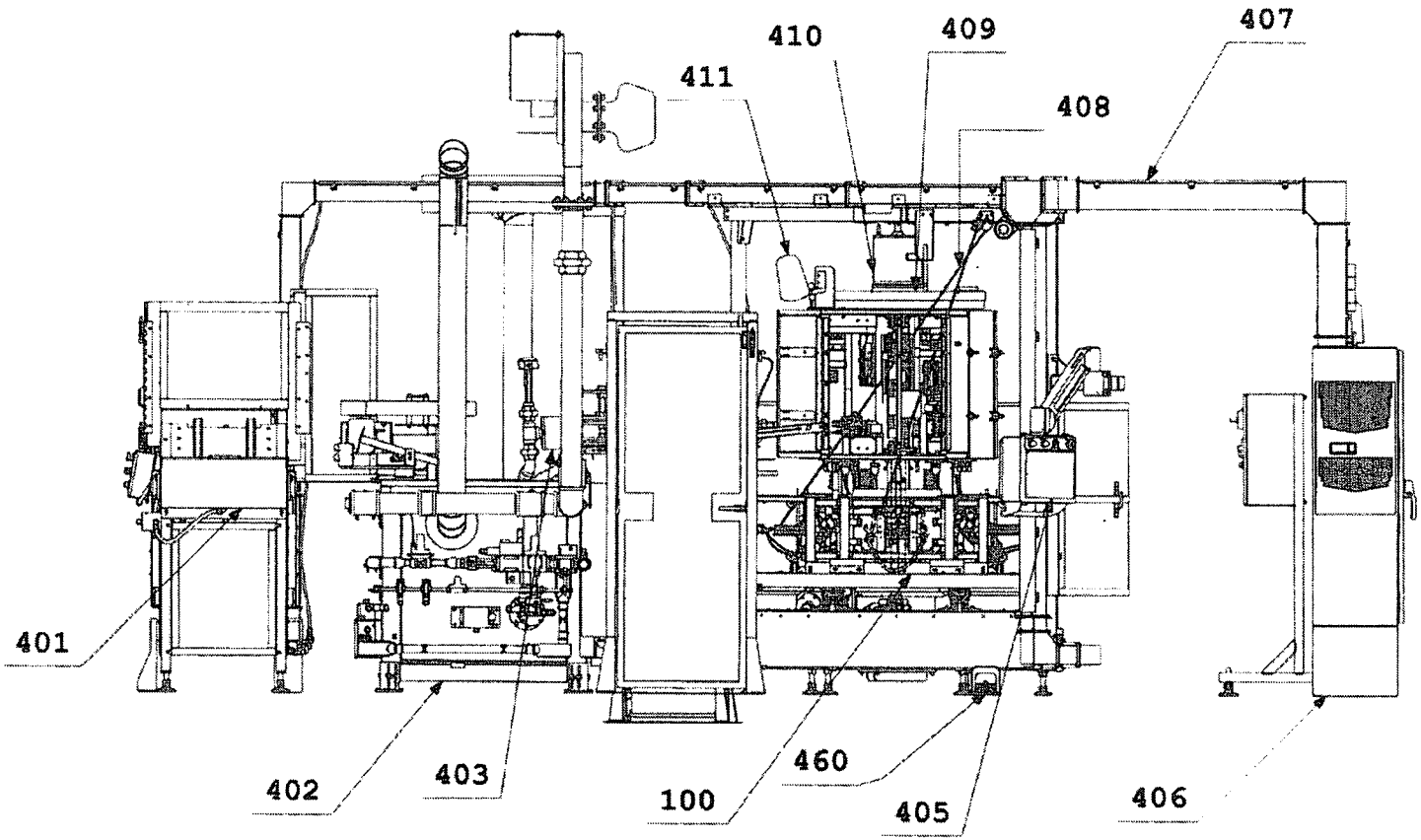
FIG. 8 illustrates a side plan view of a die casting machine comprising the carousel of FIG. 1.
Figure 10:
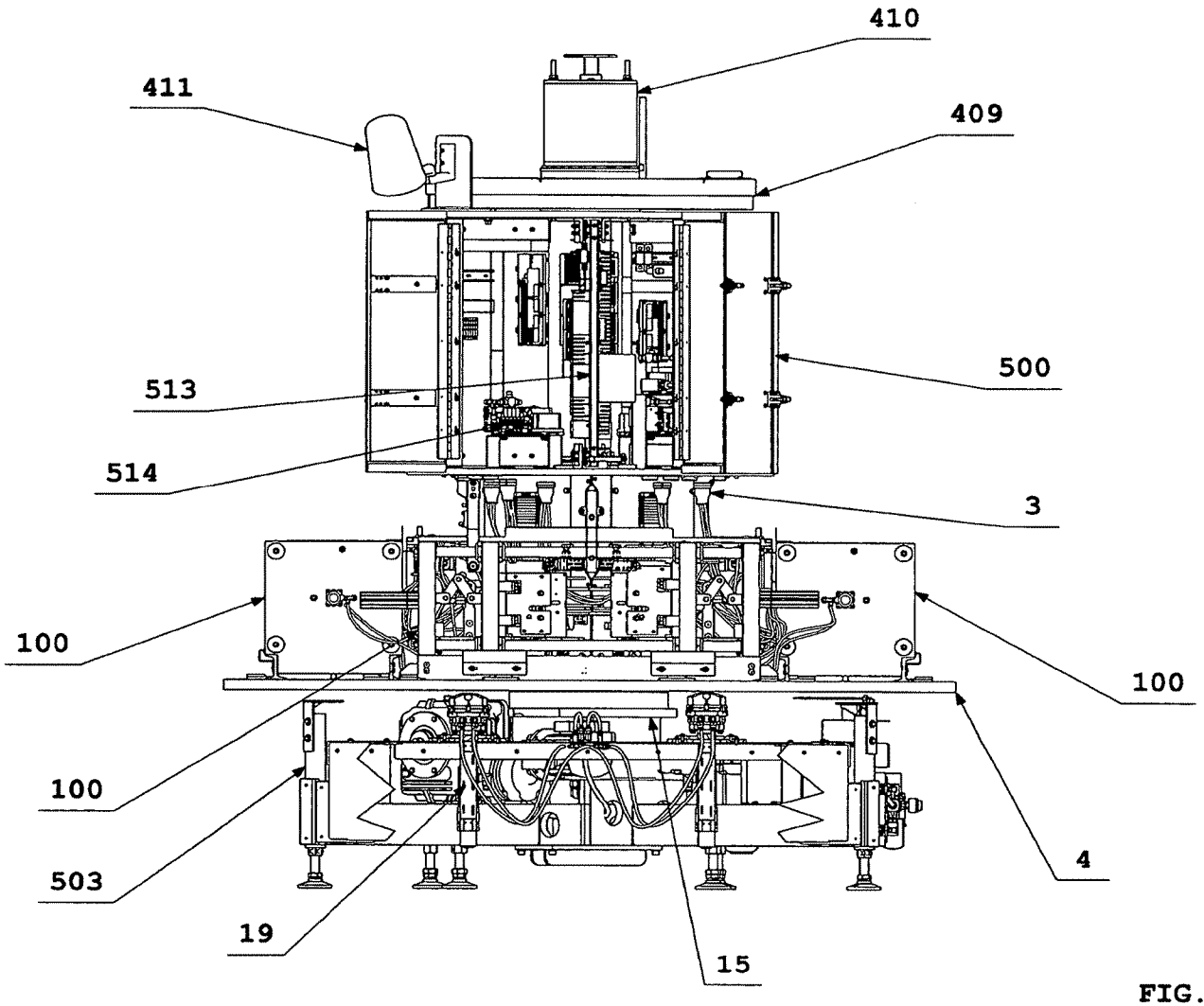
FIG. 10 illustrates a front plan view of the carousel and central cabinet of the die casting machine of FIG. 8.

FIG. 8 illustrates a mold 100 on a carousel as set up for casting. Each stage in the process is programmed and controlled by the control interface 405, which may be wirelessly coupled to the antenna 411 mounted on the upper portion of the cabinet 500, as best seen in FIG. 10, with the cabinet doors open. A circular, electrical rotating slip-ring 410 brings power into the cabinet. A cooling hood 409 cools the electrical cabinet. Sensors 408, such as light beams, detect when an operator or robot is accessing the mold or the carousel and prevents unsafe activation of the mold and carousel. Power is distributed from the electrical power supply control unit 406 to the electrical slip-ring 410 and control panel 405 via an overhead gantry 407. As shown in the example of FIG. 10, the upper electrical cabinet 500 comprises a plurality of pull out panels 513, one panel 513 for each mold 100, in this example.

Ingots of metal are delivered to a melting furnace 402 by a conveyor 401. An insert may be inserted into one of the mold cavity halves, and the mold may be closed on the insert. The pin cylinders 113, 126 are not activated, but the pins are displaced with the mold halves and are positioned at the surface of the die cavity. The mold 100 may be rotated to the next position by rotating the carousel 90 degrees, and a heated line 403 delivers molten metal to the mold 100 for casting, when a valve opens. The preheated mold 100 is filled with molten metal embedding the insert within the molten metal, while the second mold is prepared and closed. Then, the carousel is rotated to the next position. Each mold is prepared the same way and is filled with molten metal, also, in turn. Then, the carousel is rotated, until all of the molds are filled with molten metal, and the first mold 100 returns to its original position.

At this stage, the molten metal has solidified in the mold 100. The mold toggle yokes 114, 123 are engaged pneumatically by the respective grippers 115, 122, as best shown in the cross sectional view of FIG. 4. Then, the electric linear actuators 116, 121 pull the mold halves 104, 109 apart. The brake on each pin cylinder 113, 126 prevents the pins from being retracted with the mold halves; therefore, the now solidified part 106 is suspended in mid-air by the pins 105, 108. The robot or human operator, with or without a tool, grabs the part 106, steps on interlock pedal 460 and activates the pin cylinders 113, 126, which releases the brake and activates retraction of the pins 105, 108, releasing the part 106 from the pins. An insert may be inserted into one-half of the mold cavity and the process may be repeated for the first mold, and the same process may be repeated for each subsequent die on the carousel. In this way, the molds are operated at an optimized rate, with the chills 118, 119 coming into contact with the mold cavity assembly 311, as required, under control of the program set by the control panel 405, for example. Thus, the temperature of the mold cavity assembly 311 and the part 106 are controlled during solidification of the part 106, automatically, for example, while the operator continues to remove cast parts, prepare the mold cavity and fill the mold cavity with molten metal.

Figure 9:
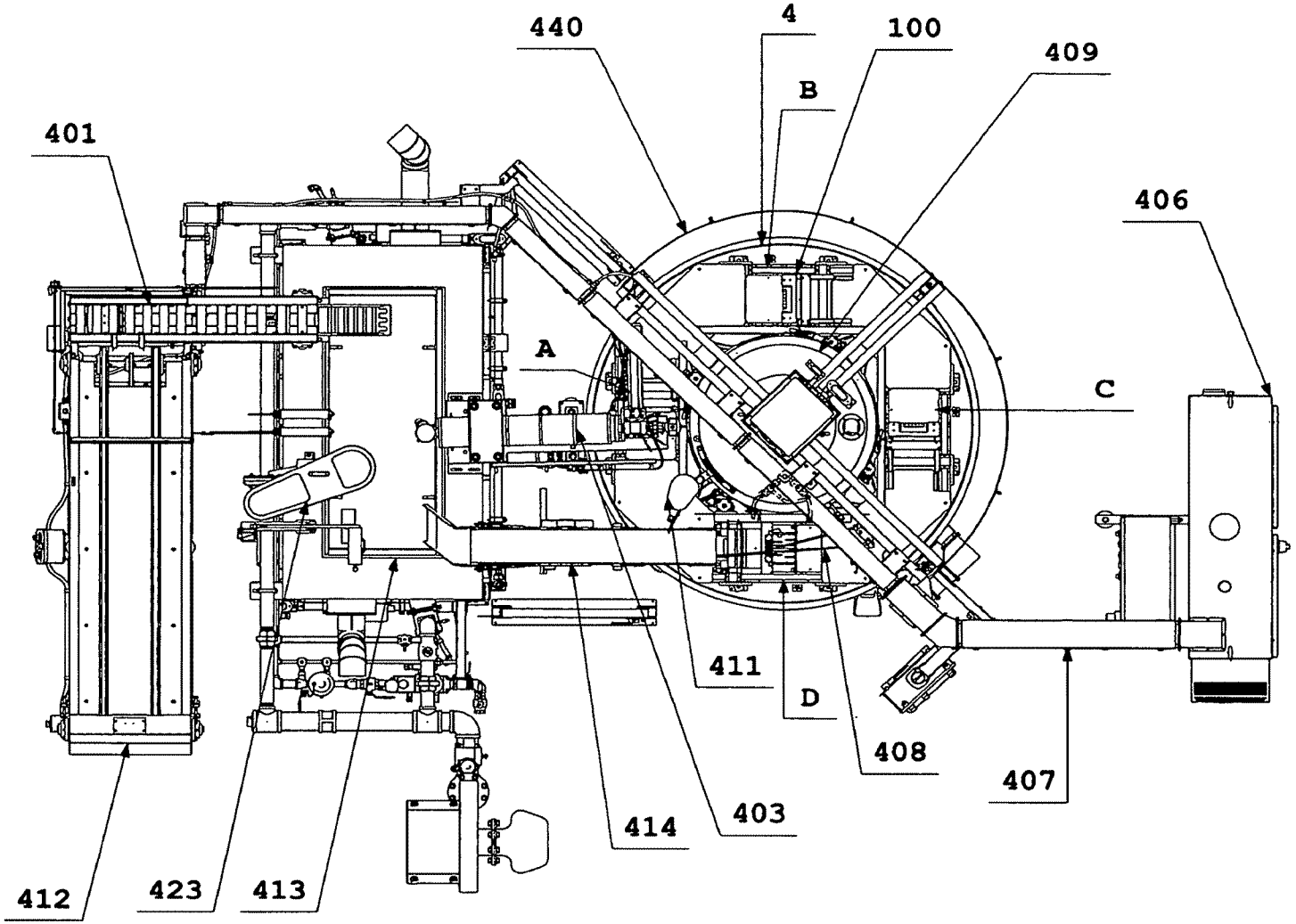
FIG. 9 illustrates a top plan view of the die casting machine of FIG. 8.

FIG. 9 shows a top view of four mold positions A, B, C, D in the arrangement shown in FIG. 8. The conveyor 401 is a tilting conveyor that may be used to deposit one metal ingot at a time into the furnace 413 from a metal ingot pig feeder 412. In one example, the metal ingot is a lead (Pb) or a lead alloy ingot. A gate return conveyor 414 conveys the sprues and header from the tiltable mold gate 103 back to the furnace 413. The molten metal line 403 is better seen in FIG. 9, connecting molten metal from the furnace 413 to the mold 100, when the mold is rotated on the carousel to position A. A molten metal pump 423 pumps the molten metal through the line 403. When the mold is rotated to position D, the cast part is ready to be removed from the mold 100. From this view, a safety shield 440 can be seen that shields the carousel from contact, except on the side of the carousel where an operator or robot needs to interact with the mold 100.

In FIG. 10, one of four pneumatic control manifolds 514 is shown in the upper electrical cabinet 500. Also, a side view of the rotary, electrical power slip-ring supply 410 is shown in relation to the stationary cabinet cooling supply hood 409. A structural support 503 is shown as one of the frame support members in relation to the rotary indexer 15 and rotary carousel 4, for example. The rotary indexer 15 is supported by the structural support 503 and rotates the carousel 4 in 90 degree increments, in this example.

This detailed description provides examples including features and elements of the claims for the purpose of enabling a person having ordinary skill in the art to make and use the inventions recited in the claims. However, these examples are not intended to limit the scope of the claims, directly. Instead, the examples provide features and elements of the claims that, having been disclosed in these descriptions, claims and drawings, may be altered and combined in ways that are known in the art.

What is claimed is:

1. A die casting apparatus for casting a part including an inserted component, the die casting apparatus comprises:

a plurality of molds, each comprising a first portion and a second portion and forming a cavity wherein the inserted component is inserted, such that the inserted component is embedded and integrated within the part, and a first toggle mechanism coupled to the first portion and arranged such that the first toggle mechanism opens and closes the first portion of the mold;

a rotary carousel, wherein the plurality of molds are disposed on the carousel, and the carousel comprises a drive for rotating the carousel and a rotary table, wherein the rotary table comprises at least one through hole, the at least one through hole being disposed under the first toggle mechanism of one of the plurality of molds, when the one of the plurality of molds is positioned in a casting position; and a first mold opening actuator comprises a grip arranged at one end of a linear actuator, such that the grip is capable of extending through the at least one through hole of the rotary table, when the first mold opening actuator is arranged under the first toggle mechanism of the one of the plurality of molds, when the one of the plurality of molds is positioned in a casting position on the rotary carousel; and wherein the grip of the first mold opening actuator temporarily couples the opening actuator with the first toggle mechanism of the one of the plurality of molds, when the one of the plurality of molds is positioned in a casting position by extending through the at least one through hole and gripping the first toggle mechanism of one of the plurality of molds, when the one of the plurality of molds is positioned in a casting position, and the first toggle mechanism activates the closing and opening of the first mold portion of the mold, when the first mold opening actuator is activated for closing and opening of the first portion of the mold.

2. The apparatus of claim 1, wherein the first portion of the mold comprises a plurality of pins, and at least one of the plurality of pins extends through the first portion; and a first pin actuator is coupled to the at least one of the plurality of pins extending through the first portion of the mold, and the first pin actuator comprises a brake, such that, when the first portion is parted from the second portion of the mold, the at least one of the plurality of pins, extending through the first portion of the mold, remains in contact with the part, while the first portion of the mold is retracted from the part by the first toggle mechanism.

3. The apparatus of claim 2, wherein the opening of the first portion of the mold by the first toggle mechanism opens the mold, while the brake of the first pin actuator causes the at least one of the plurality of pins, extending through the first portion of the mold, to remain in contact with the part, while the first portion of the mold is retracted from the part by the first toggle mechanism.

4. The apparatus of claim 3, wherein closing of the first portion of the mold by the first toggle mechanism pulls the plurality of pins into position in the mold at a surface of the cavity.

5. The apparatus of claim 4, wherein the first pin actuator coupled to the at least one of the plurality of pins is activated by a controller, retracting the at least one of the plurality of pins from the part and releasing the part.

6. The apparatus of claim 4, further comprising a robot arranged to secure the part before the closing of the first portion of the mold.

7. The apparatus of claim 2, further comprising:

a second pin actuator coupled to at least one of a plurality of pins extending through the second portion of the mold, wherein the second pin actuator comprises a brake, such that, when the second portion is parted from the first portion by a second toggle mechanism, temporarily attached to a second grip, extending through a through hole of the rotary table, either the same through hole as the at least one through hole or another through hole, the second grip extending from a second mold opening actuator, and the at least one of the plurality of pins of the second pin actuator, extending through the second portion of the mold, remains in contact with the part, while the second portion of the mold is retracted from the part, when the brake of the second pin actuator is activated.

8. The apparatus of claim 7, wherein the rotary table comprises a pair of through holes, each through hole is disposed under a respective one of the first toggle mechanism and the second toggle mechanism of the one of the plurality of molds, when the one of the plurality of molds is positioned in a casting position on the rotary carousel.

9. The apparatus of claim 1, wherein the rotary table rotates on a rotary indexer, such that the first toggle mechanism is disposed above the first mold opening actuator, when the one of the plurality of molds is rotated on the rotary table into an opening and closing position above the first mold opening actuator by the rotary indexer.

10. The apparatus of claim 9, wherein closing of the first portion of the mold by the first toggle mechanism pulls the plurality of pins into position in the mold at a surface of the cavity.

11. The apparatus of claim 1, further comprising a tiltable gate and gate shearing device arranged on one of the first portion, the second portion or both the first portion and the second portion of the mold, such that, after molten metal is cast and before the mold is opened, the gate shearing device is activated and shears the gate of the part, removing sprues and a header of a casting from the part.

12. The apparatus of claim 11, further comprising a conveyor, wherein the header and the sprues of the casting are deposited by the tiltable gate on the conveyor, and the conveyor directs the header and the sprues to a stationary furnace.

13. The apparatus of claim 1, wherein each of the plurality of molds disposed on the rotary table is disposed above the first mold opening actuator, in turn, as the rotary table is rotated by a rotary indexer to pour or inject a molten material into each, respective, mold cavity and, in turn, to remove the part from each, respective, mold cavity, when the part is solidified.

14. The apparatus of claim 13, wherein the plurality of molds comprises four molds, displaced at 90 degrees from each other, and the rotary indexer rotates the rotary table in 90 degree increments.

15. The apparatus of claim 1, further comprising a first chill plate comprising a plate actuator and a temperature regulated plate, wherein the plate actuator moves the temperature regulated plate into contact with the first portion of the mold, under control of a controller responding to a signal from a temperature sensing device.

16. A method for temperature regulation during casting using the apparatus of claim 1, comprising:

measuring a temperature related to the temperature of the first portion, the second portion or both the first portion and the second portion of the mold, using a temperature sensing device;

transmitting a signal related to the temperature measured in the step of measuring to a controller;

regulating the temperature of a temperature regulated plate of a first chill plate, a second chill plate or both a first chill plate and a second chill plate; and activating at least one plate actuator and moving at least one temperature regulated plate into contact with the first portion of the mold, the second portion of the mold or both the first portion of the mold and the second portion of the mold under control of the controller responding to the signal from the temperature sensing device.

17. A method of operating the apparatus of claim 1, comprising:

rotating one of the plurality of molds into a casting position;

extending the grip of the first mold opening actuator through the at least one through hole;

temporarily coupling the grip of the first mold opening actuator to the first toggle mechanism of the one of the plurality of molds;

positioning the inserted component between the first portion and the second portion of the mold;

closing the first portion on the second portion of the mold by activating the first toggle mechanism using the first mold opening actuator;

pouring molten metal into the cavity formed by the first portion and the second portion of the mold;

decoupling the grip of the first mold opening actuator;

withdrawing the grip through the at least one through hole; and rotating the rotary table of the carousel to position another of the plurality of molds into the casting position.

18. The method of claim 17, further comprising, after the step of rotating the rotary table of the carousel to position another of the plurality of molds into the casting position:

waiting until the molten metal solidifies around the insert forming a cast metal part;

rotating the one of the plurality of molds into the casting position, again;

extending the grip of the first mold opening actuator through the at least one through hole;

temporarily coupling the grip of the first mold opening actuator to the first toggle mechanism of the one of the plurality of molds;

opening the first portion of the mold by activating the first toggle mechanism, while holding the cast metal part from falling;

removing the cast metal part;

closing the first portion of the mold by activating the first toggle mechanism, while inserting the inserted component between the first portion and the second portion of the mold;

pouring molten metal into the cavity formed by the first portion and the second portion of the mold;

decoupling the grip of the first mold opening actuator;

withdrawing the grip through the at least one through hole; and rotating the rotary table of the carousel to position another of the plurality of molds into the casting position.

19. The method of claim 18, wherein the step of opening the first portion of the mold by activating the first toggle mechanism, while holding the cast metal part from falling, comprises activating a braking mechanism of at least one of the plurality of pins extending through the first portion of the mold, and the step of activating the braking mechanism comprises braking the at least one of the plurality of pins, extending through the first portion of the mold, fixing the at least one of the plurality of pins in contact with the part, while the first portion of the mold is retracted from the part by the first toggle mechanism.

20. The method of claim 17, further comprising, prior to the step of removing the cast metal part:

activating a gate shearing device such that the gate shearing device shears the gate, removing header and sprues of the casting from the rest of the casting; and tilting a tiltable gate arranged on one of the first portion, the second portion or both the first portion and the second portion of the mold, such that the header and the sprues are redirected to a stationary furnace for remelting.

* * * * *